US009181694B1

(12) United States Patent
Munoz

(10) Patent No.: US 9,181,694 B1
(45) Date of Patent: Nov. 10, 2015

(54) SEGMENTED BUILDING CONSTRUCTION WITH MULTIPLE FACADES

(71) Applicant: Alfredo Munoz, Jersey City, NJ (US)

(72) Inventor: Alfredo Munoz, Jersey City, NJ (US)

( * ) Notice: Subject to any disclaimer, the term of this patent is extended or adjusted under 35 U.S.C. 154(b) by 0 days.

(21) Appl. No.: 14/498,873

(22) Filed: Sep. 26, 2014

(51) Int. Cl.

| | |
|---|---|
| ***E04H 1/00*** | (2006.01) |
| ***E04B 2/88*** | (2006.01) |
| ***E04H 1/04*** | (2006.01) |
| ***E04H 1/06*** | (2006.01) |
| ***E04B 1/35*** | (2006.01) |
| ***E04F 19/00*** | (2006.01) |

(52) U.S. Cl.
CPC ... *E04B 2/88* (2013.01); *E04B 1/35* (2013.01); *E04F 19/00* (2013.01); *E04H 1/04* (2013.01); *E04H 1/06* (2013.01)

(58) Field of Classification Search
CPC ..... E04H 1/04; E04H 1/00; E04H 1/005; E04H 1/06
USPC ..... 52/234, 236.3, 236.4
See application file for complete search history.

(56) References Cited

U.S. PATENT DOCUMENTS

| | | | | |
|---|---|---|---|---|
| 3,884,001 | A * | 5/1975 | Tylius | 52/185 |
| 4,035,973 | A * | 7/1977 | Sutelan | 52/263 |
| 5,809,704 | A * | 9/1998 | Stewart et al. | 52/169.4 |
| 6,244,003 | B1 * | 6/2001 | Allison | 52/234 |
| 6,922,960 | B2 * | 8/2005 | Sataka | 52/236.3 |
| 7,036,276 | B1 * | 5/2006 | Apel | 52/79.1 |
| 7,237,361 | B2 * | 7/2007 | Zwimpfer | 52/79.1 |
| 7,320,200 | B1 * | 1/2008 | Eisner | 52/236.1 |
| 7,540,120 | B2 * | 6/2009 | Miller | 52/236.3 |
| 7,676,998 | B2 * | 3/2010 | Lessard | 52/234 |
| 2009/0113821 | A1 * | 5/2009 | Guo | 52/173.1 |
| 2009/0151280 | A1 * | 6/2009 | Jones et al. | 52/236.3 |
| 2009/0293384 | A1 * | 12/2009 | Miller | 52/185 |
| 2011/0173907 | A1 * | 7/2011 | Katsalidis | 52/236.3 |
| 2011/0296789 | A1 * | 12/2011 | Collins et al. | 52/741.4 |

* cited by examiner

*Primary Examiner* — Mark Wendell

(57) ABSTRACT

The present invention relates to a building for a high-rise construction. Specifically, embodiments of the present invention provide for a single, cohesive building that has the appearance of a multi-segmented building. Each segment of the building may be separated by an open-air area and have a different façade than adjacent segments.

16 Claims, 8 Drawing Sheets

SEGMENTED BUILDING CONSTRUCTION WITH MULTIPLE FACADES

FIELD OF THE INVENTION

The present invention relates to a building for a high-rise construction. Specifically, embodiments of the present invention provide for a single, cohesive building that has the appearance of a multi-segmented building. Each segment of the building may be separated by an open-air area and have a different façade than adjacent segments.

BACKGROUND OF THE INVENTION

The façade of traditional high-rise building constructions is typically uniform from top to bottom, as the same materials used throughout the entire façade, thereby giving a largely homogenous appearance to the building. Without using different façades, it is difficult to differentiate between different parts of the building. Furthermore, by using only one style for the façade, a building lacks the character of a building that integrates multiple types of façades. Additionally, traditional high-rise building constructions have a limited amount of open-air and green spaces. Open-air and green space is limited due to the fact that a typical high-rise building only incorporates open-air space on the roof portions of a building. Often times, there is not enough open-air and green space incorporated in the construction of the building to adequately meet the demands on the building inhabitants.

Therefore, there is a new in the art for a construction that incorporates multiple façades into a single high-rise building and increases the amount open-air and green spaces that is available without increasing the footprint of the building or the building's roof areas. These and other features and advantages of the present invention will be explained and will become obvious to one skilled in the art through the summary of the invention that follows.

SUMMARY OF THE INVENTION

Accordingly, it is an object of the present invention to provide a unitary building construction comprised of multiple integrated segments, each with a different façade distinguishing it from adjacent segments.

According to an embodiment of the present invention, a multi-floor building construction, the multi-floor building construction comprising: a first building portion configured with a first façade style, a second building portion configured with a second façade style, a core structure connecting between the first building portion and the second building portion, and an open-air area formed between the first building portion and the second building portion and extending from the core structure.

According to an embodiment of the present invention, the first façade style is visually distinguishable from the second façade style.

According to an embodiment of the present invention, the first façade style is physically distinguishable from the second façade style.

According to an embodiment of the present invention, the first building portion comprises a different internal layout than the second building portion.

According to an embodiment of the present invention, a multi-floor building construction, the multi-floor building construction comprising: a first building portion configured with a first façade style, a second building portion configured with a second façade style, and a core structure connecting between the first building portion and the second building portion.

According to an embodiment of the present invention, the first building portion and the second building portion are aligned in a substantially horizontal arrangement.

According to an embodiment of the present invention, the first building portion and the second building portion are aligned in a substantially vertical arrangement.

According to an embodiment of the present invention, the multi-floor building further comprises an open-air area formed between the first building portion and the second building portion and extending from the core structure.

According to an embodiment of the present invention, a multi-floor building construction, the multi-floor building construction comprising: a plurality of building portions each configured with one of a plurality of façade styles, and one or more core structure connecting the plurality of building portions.

According to an embodiment of the present invention, two or more of the plurality of building portions are positioned on a vertical axis from one another.

According to an embodiment of the present invention, two or more of the plurality of building portions are positioned on a horizontal axis from one another.

According to an embodiment of the present invention, the plurality of building portions are aligned such that two or more building portions are aligned on a vertical axis from one another and two or more building portions are aligned on a horizontal axis from one another.

According to an embodiment of the present invention, at least two of the plurality of building portions are positioned in a vertical offset from one another, having a base portion of a first building portion positioned at a different height relative to a base portion of a second building portion.

According to an embodiment of the present invention, the first building portion has a first façade style that is visually distinguishable from a façade style of the second building portion.

According to an embodiment of the present invention, the first building portion has a first façade style that is physically distinguishable from a façade style of the second building portion.

According to an embodiment of the present invention, the multi-floor building construction further comprises: an first open-air area formed between the first building portion and a third building portion and extending from one of the core structures, and an second open-air area formed between the second building portion and a fourth building portion, and extending from one of the core structures, wherein the first open-air area and second open-air area are positioned in a vertical offset from one another having a base portion of the first open area positioned at a different height relative to a base portion of the second open-air area.

According to an embodiment of the present invention, a first building portion of the plurality of building portions comprises a different internal layout than a second building portion of the plurality of building portions.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
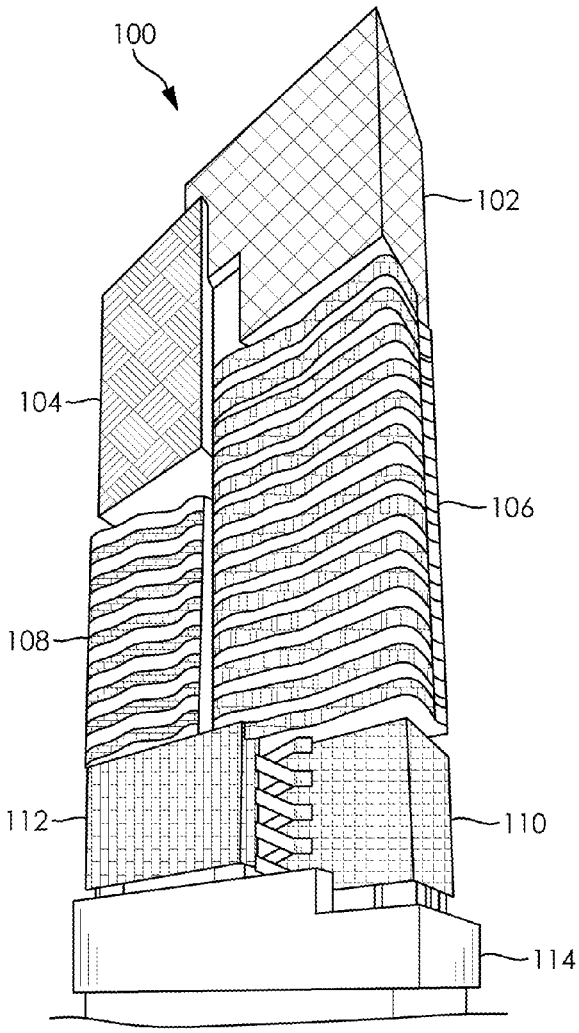
FIG. 1 is a perspective view of a multi-floor building construction, in accordance with an embodiment of the present invention.

The present invention relates to a building for a high-rise construction. Specifically, embodiments of the present invention provide for a single, cohesive building that has the appearance of a multi-segmented building. Each segment of the building may be separated by an open-air area and have a different façade than adjacent segments. Throughout this disclosure, these building segments may alternatively be referred as building portions. In this context, the words "segment(s)" and "portion(s)" may be used interchangeably and understood as equivalent.

According to an embodiment of the present invention, a construction for a single, multi-floor building that is adapted to appear as a collection of multiple individual buildings. In a preferred embodiment, the multi-floor building construction is comprised of one or more building portions, a core structure, and one or more open-air areas. In the preferred embodiment, the building portions are interconnected by the core structure. The open-air areas may be formed between any of the building portions. In the preferred embodiment, the open-air portions extend from the core structure and mark the boundary between adjacent building portions. In alternate embodiments, the multi-floor building construction may include fewer or additional features. One of ordinary skill in the art would appreciate that numerous possible configurations for a multi-story building with multiple distinct building portions, and embodiments of the present invention are contemplated for use with any such configuration.

According to an embodiment of the present invention, the multi-floor building construction is comprised of one or more building portions. In a preferred embodiment, each of the building portions is adapted to appear as distinct unit from other adjacent building portions, but form a single cohesive building. In the preferred embodiment, this is achieved as each of the building portions is connected to by the core structure. In the preferred embodiment, each of the building portions may be separated by an open-air area and make use of a different façade than the adjacent building portions in order to have each building portion appear as a separate building portion. In some embodiments, the façade of a first building portion may be visually distinct from a façade of a second building portion. In some embodiments, the façade of a first building portion may be physically distinct from a façade of a second building portion. One of ordinary skill in the art would appreciate that there are numerous designs and layouts for a building with a core structure that connects multiple building portions, and embodiments of the present invention are contemplated for use with any such design or layout.

According to an embodiment of the present invention, each building portion of the multi-floor building construction may have a different internal layout. In a preferred embodiment, each of building portions may be configured with a different internal layout. In the preferred embodiment, the core structure allows each building portion to be a separate unit that is physically distinct from adjacent building portions. In many traditional multi-floor buildings, each floor of the building is practically identical to the layout of the floor above and below it. For example, a traditional multi-floor apartment building is divided into vertical columns of apartment units. In a given column, all of the units on all of the floors in that column have the same general layout and floor plan. This does not allow for flexibility in design and layout among the various floors of a building. The multi-floor building construction of the present invention has the advantage of providing multiple different internal layouts within one building. By segmenting the building into multiple building portions, each building portion can have separate internal layouts. In the preferred embodiment, this is made possible because the only significant element that any two building portions share is the core structure. By utilizing a common core structure to unite each of the distinct building portions, the present invention allows for greater variation in the internal layout of the building. Correspondingly, a greater variation in the internal layout allows for hybrid use, including residential, infrastructural, cultural, commercial, and agricultural applications. One of ordinary skill in the art would appreciate there are many benefits to uniting distinct building portions around a core structure, and embodiments of the present invention are contemplated to take advantage of each such benefits.

According to an embodiment of the present invention, the multi-floor building construction is comprised of a core structure. In a preferred embodiment, the core structure is formed from a single core structure that extends vertically through the central axis of the multi-floor building construction. In alternate preferred embodiments, the core structure may be formed from multiple core structures that extend vertically from a common base (or podium) and form the internal connection between the different building segments of the multi-floor building construction. In embodiments where multiple core structures are utilized, each of the multiple core structures act collectively as a common core that combines the different building portions. In the preferred embodiment, the core structure serves as a common connection between each of the building portions on that core structure and may include building service features, including, but not limited to, connections and pathways for power, water, sewer and other utility services, communications connections (e.g. telephone, internet, and television), elevators, and stairways. In certain embodiments with more than one core structure, each of the core structures may share a common base (or podium) and each of those core structures provide a common connection between each of the building portions that are located on that core structure and the common base (or podium). In other embodiments with the more than one core structure, those core structures do not share a base. In the preferred embodiment, the core structure is central to any of the building portions that are connected to the core structure. On the other hand, a core structure does not have to be located in the center of the overall design of the building or in the center of the base portion of the building. For example the core structure may be offset to one side or another of an overall building design. Likewise, in building designs with more than one core structure, each core structure could be spaced as necessary to achieve a desired design plan. One of ordinary skill in the art would appreciate that there are many possible configurations for a core structure, and embodiments of the present invention are contemplated for use with any such configuration.

According to an embodiment of the present invention, each of the building portions are interconnected through the core structure. In a preferred embodiment, the use of the core structure allows for a plurality of arrangements for each of the building portions being organized around the core structure and enables the building to take advantage of its height to vary its views and sightlines. In some embodiments of the multi-floor building construction, the building portions may be aligned in a substantially horizontal arrangement around the horizontal axis of the core structure. In some embodiments of the multi-floor building construction, the building portions may be aligned in a substantially vertical arrangement about the vertical axis of the core structure. In some embodiments of the multi-floor building construction, building portions may be aligned around both vertically and horizontally around the core structure. In some embodiments of the multi-floor building construction, the building portions may be positioned vertically along the core structure such that a base portion of a first building portion is offset at a different height relative to a base portion of a second building portion. In some embodiments the arrangement of the different building segments may be largely balanced in distribution and organization around the circumference of the core structure, while in other embodiments building portions may only be arranged on certain areas to achieve an unbalanced design appearance. In the preferred embodiment, the various possible alignments of the different building portions allow for a variety of views and sightlines to be created that are not possible with a traditional building. For example, different offsets and alignments of the various building portions may allow each building portion to have sightlines that are not interrupted by the other building portions. One of ordinary skill in the art would appreciate that there are numerous possible arrangements for the building portion on the core structure, and embodiments of the present invention are contemplated for use with any such arrangement.

According to an embodiment of the present invention, the multi-floor building construction has an evolving shape along its vertical axis. In a preferred embodiment, the use of multiple building portions creates a variable shape along the vertical axis of the building. In particular, the use of one or more core structures allows for a building plan with multiple different building portions, each of which has a different design and appearance, which creates an evolving shape along the vertical axis of the building. One of ordinary skill in the art would appreciate there are numerous designs through which the vertical axis of the building could be varied, and embodiments of the present invention are contemplated for use with any such design.

According to an embodiment of the present invention, the multi-floor building construction has an evolving shape across its horizontal axis. In a preferred embodiment, the use of multiple building portions creates a variable shape along the horizontal axis of the building. In particular, the use of one or more core structures allows for a building plan with multiple different building portions, each of which has a different design and appearance, which creates an evolving shape along the horizontal axis of the building. One of ordinary skill in the art would appreciate there are numerous designs through which the horizontal axis of the building could be varied, and embodiments of the present invention are contemplated for use with any such design.

According to an embodiment of the present invention, the multi-floor building construction may have its program set according the orientation of the building. In a preferred embodiment, the use of multiple building portions, each connected to one or more core structures, allows for the building to take advantage of its height and the entirety of the 360 degrees of space around a given core structure. Traditional tower designs are largely symmetric, resulting in buildings that may not be ideally orientated on every side of the building. For example, the symmetric design of traditional buildings do not allow for different portions of the building to be orientated to maximize (or minimize) sun exposure, views, and other aspects associated with the plot of a building. On the other hand, the use of multiple individual building portions, as in present invention, allows for an asymmetric building design that can take advantage of the entire 360 degrees around the building. For example, the use of multiple building portions allows each building portion to be offset from each other in order to take advantage of the unique perspectives that are be offered at various heights along the vertical axis of the multi-floor building. In particular, because the multi-floor building construction of the present invention is asymmetric, the location and orientation of one building portion does not necessarily limit the orientation of a other building portion. This type of design flexibility allows for a multi-story building to take full advantage of the entirety of the 360 degree space around the building and not be limited to the orientations offered by a symmetric building design. One of ordinary skill in the art would appreciate that there are many benefits to a building having is program set according to its orientation, and embodiments of the present invention are contemplated to take advantage of any such benefit.

According to an embodiment of the present invention, each of the building portions of the multi-story building construction is configured with a façade. In a preferred embodiment, each of the different building portions is configured with different façade. In an alternate embodiment, certain of the building portions may have the same façade as other building portions. In the preferred embodiment, the façades are useful to further distinguish one building portion from another building portion. In some embodiments, the façades may physically distinguish a first building portion from a second building portion. In other embodiments, the façades may visually distinguish a first building portion from a second building portion. In the preferred embodiment, examples of façades may include, but are not limited to, (i) stucco, (ii) glass, (iii) brick, stone, or other masonry, (iv) metal, (v) composites, (vi) wood, (vii) concrete or other cementitious product, (viii) plastics, and (ix) exposed insulations. In some embodiments, the façades may incorporate additional features including, but not limited to, weather resistance (e.g. wind and precipitation control), fire resistance, light shading/protection, thermal and/or acoustic insulation, decorative enhancements, and features to improve ventilation and air circulation. In the preferred embodiment, the material used for the façade may be varied according to the orientation of a given building portion. For example, a building portion that receives more sunlight than other building portions may incorporate materials into its façade that help control sun radiation. One of ordinary skill in the art would appreciate there are many useful benefits of employing façades on a building, and embodiments of the present invention are contemplated to take advantage of any such benefit.

According to an embodiment of the present invention, the multi-floor building construction is comprised of one or more open-air areas. In a preferred embodiment, each of the open-air areas extend from the core structure to form an open space between two adjacent building portions. In some embodiments, a first open-air area may be positioned so that is vertically offset from a second open-air area, such that the base portion of the first open-air area is positioned at a different height relative to a base portion of the second open-air area. In the preferred embodiment, the open-air area may be, but is not limited to, a green space, a garden space, a sky lobby, a refuge area or other outside area or common enclosed building areas. In some embodiments, the open-air areas may include other features, including, but not limited, swimming pools, gardens, and recreation areas. In some embodiments, the open-air areas may include enclosed or other occupied spaces that are built on the open-air space, for example a sunroom, building amenities, or greenhouse. In the preferred embodiment, the open-air space may be all or a substantial portion of the roof of a given building portion. Any portion (or the entirety) of the open-air space may be enclosed with glass or an equivalent substitute to create an enclosed space that has the appearance of being open. This demonstrates another important benefit of having multiple building portions in that the multi-floor building construction can offer an increase in the amount of open-air space in comparison to traditional building design. Traditional building design would require a building to expand its foundational footprint or the size of its roof(s) to offer more open-air space. The multi-floor building of the present invention, however, offers an increased amount of open-air space without increasing the footprint of the building or the size of the roof, as each building portion may be configured with its own open-air area(s). Additionally, as open-air areas are typically a desirable feature of a building, the increased amount of open-air areas available can increase the value of that building. One of ordinary skill in the art would appreciate there are many possible arrangements for and benefits of open-air areas, and embodiments of the present invention are contemplated to take advantage of all such arrangements and benefits.

According to an embodiment of the present invention, the multi-floor building construction may include a base section or podium. In a preferred embodiment, the base section may be comprised of a building podium that forms a common entrance for each of the one or more core structures. In the preferred embodiment, a ground floor plaza may include the main entrance to the multi-floor building construction, as well as outdoor space. In some embodiments, the access floor is constructed on top of the building podium. One of ordinary skill in the art would appreciate there are many possible designs for a ground floor plaza, and embodiments of the present invention are contemplated for use with any such design.

According to an embodiment of the present invention, the multi-floor building construction may feature a duplex layout in one or more of the building portions. In a preferred embodiment, the duplex layout may be located in one of the building portions located in the lower levels of the multi-floor building construction. In an alternate embodiment, the duplex layout may be located in one of the building portions in the upper levels of the multi-floor building construction. One of ordinary skill in the art would appreciate that there are numerous possible locations and layouts for a building portion with a duplex layout arrangement, and embodiments of the present invention are contemplated for use with any such location or layout.

According to an exemplary embodiment of the present invention, the multi-story building construction may be comprised of multiple individual building portions. In a preferred embodiment, each building portion may be physically distinct from the other building portions, while still being connected to each other by a core structure. In the preferred embodiment, each building portion may have different internal layout. As an illustrative example, the building portions of a multi-story building construction may include a ground floor plaza, an amenities portion, a duplex-layout portion, an apartment-layout portion, and a loft-layout portion. In the illustrative example, the amenities portion may feature a fitness center and other recreation or common facilities that are for use by occupants of the other building portions. Each of the other building portions are divided according the general layouts featured in each of those building portions. For example, the duplex-layout portion features living spaces with a duplex layout, the apartment-layout portion features standard apartment layouts, and the loft-layout portion features loft-style layouts. One of ordinary skill in the art would appreciate that there are numerous ways to configure a multi-story building construction featuring multiple building components, and embodiments of the present invention are contemplated for use with any such configuration.

Figure 2:
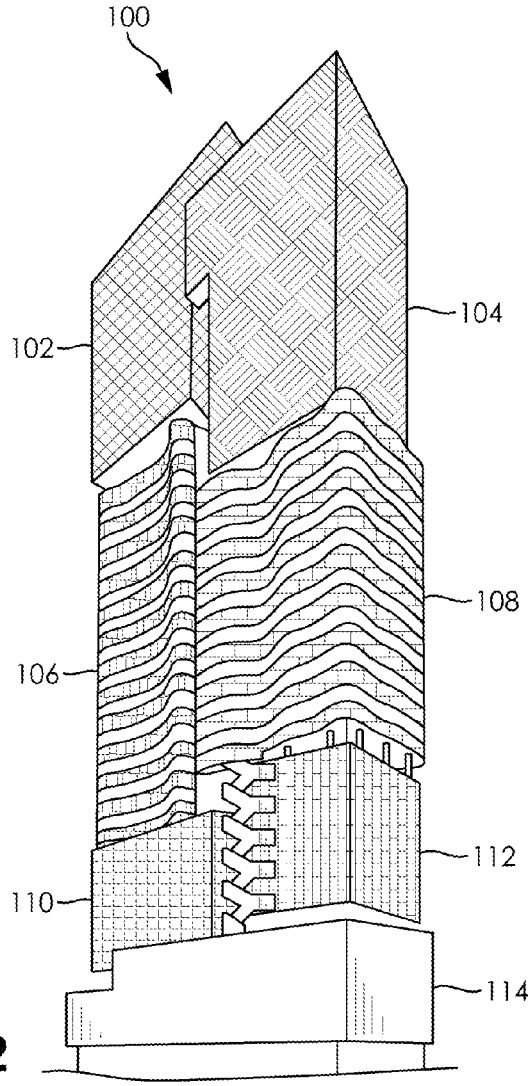
FIG. 2 is an alternate perspective view of a multi-floor building construction, in accordance with an embodiment of the present invention.

Turning now to FIGS. 1 and 2, an exemplary embodiment of a multi-floor building construction in accordance with an embodiment of the present invention. In this exemplary embodiment, the multi-floor building construction 100 is comprised of a multiple building segments (102, 104, 106, 108, 110, and 112), each of which has a different façade. In the preferred embodiment, each segment of the building may also be offset compared to adjacent portions of the building. This combination of different façades and the varying offset of the building segments help to create the illusion that each building segment is a separate building.

Figure 3:
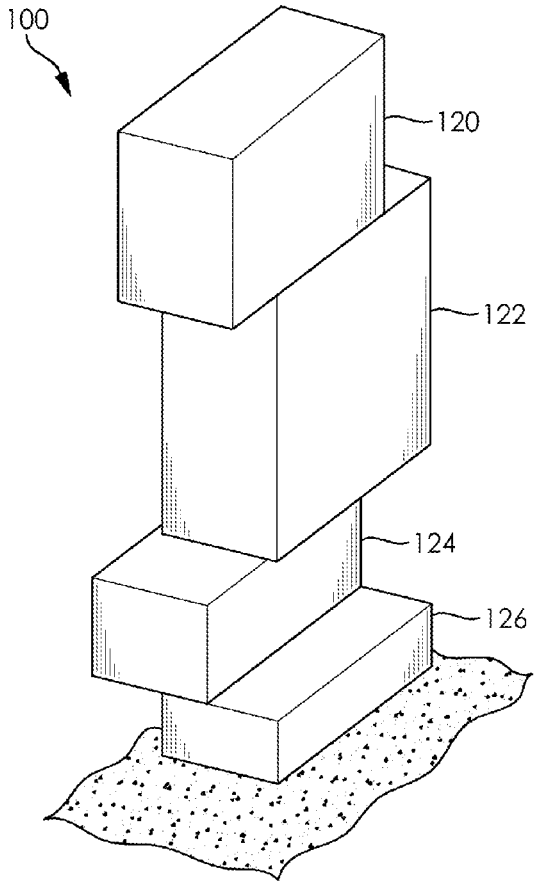
FIG. 3 is a block model illustration of the offset of the various building portions of a multi-floor building construction, in accordance with an embodiment of the present invention.

Turning now to FIG. 3, is block model of an exemplary embodiment of a multi-floor building construction in accordance with an embodiment of the present invention. In a preferred embodiment, the multi-floor building construction 100 may be comprised of multiple building segments (120, 122, 124, 126). Each of these building segments may be offset from each other so as to offer changing sight lines along the axes of the building. Furthermore, offsetting the various building segments of the building may give the illusion that each segment is actually a separate building.

Figure 4:
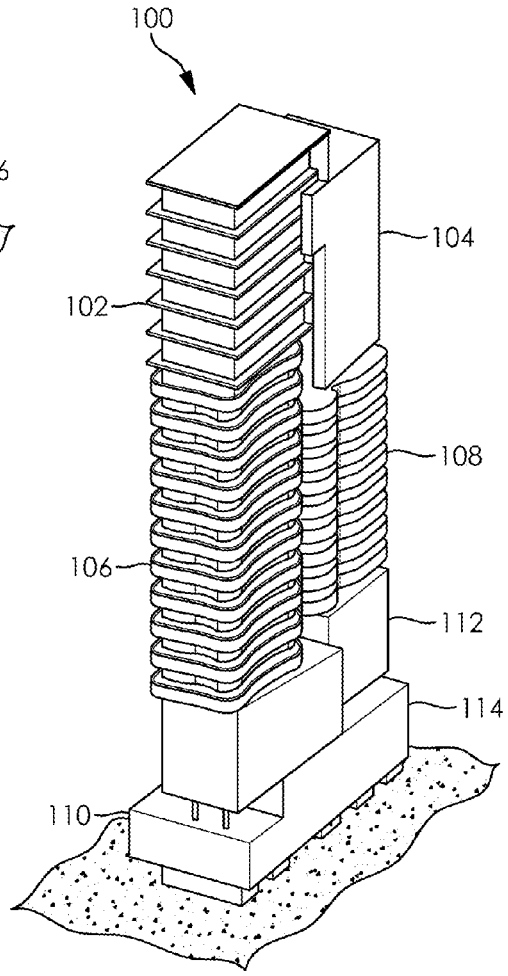
FIG. 4 is a perspective view of a multi-floor building construction, in accordance with an embodiment of the present invention.
Figure 5:
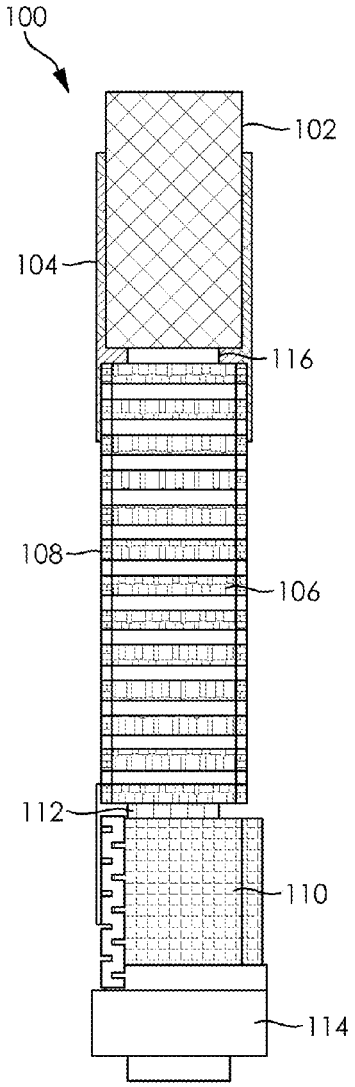
FIG. 5 is a front view of a multi-floor building construction, in accordance with an embodiment of the present invention.
Figure 6:
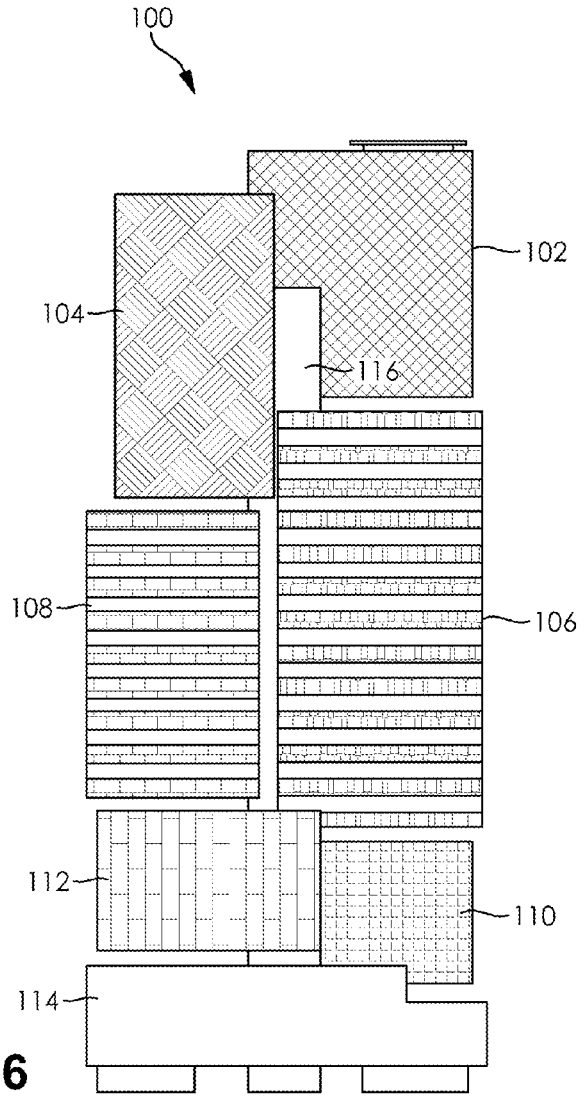
FIG. 6 is a right view of a multi-floor building construction, in accordance with an embodiment of the present invention.
Figure 7:
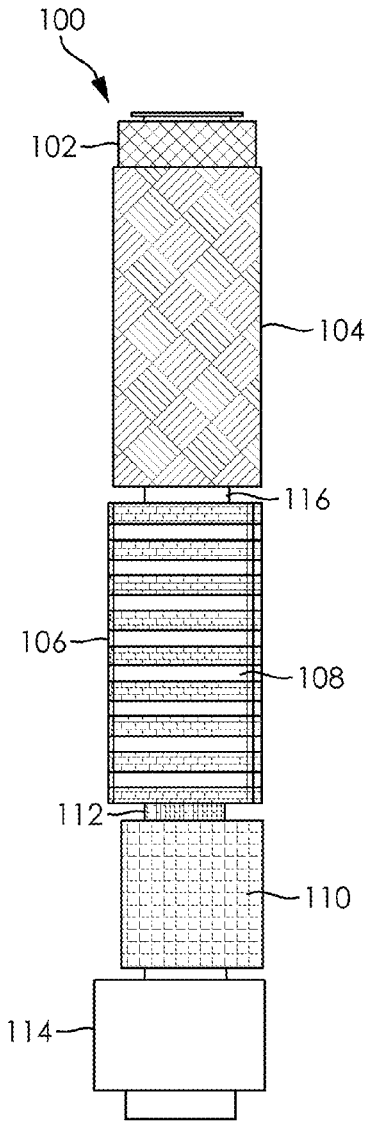
FIG. 7 is a rear view of a multi-floor building construction, in accordance with an embodiment of the present invention.
Figure 8:
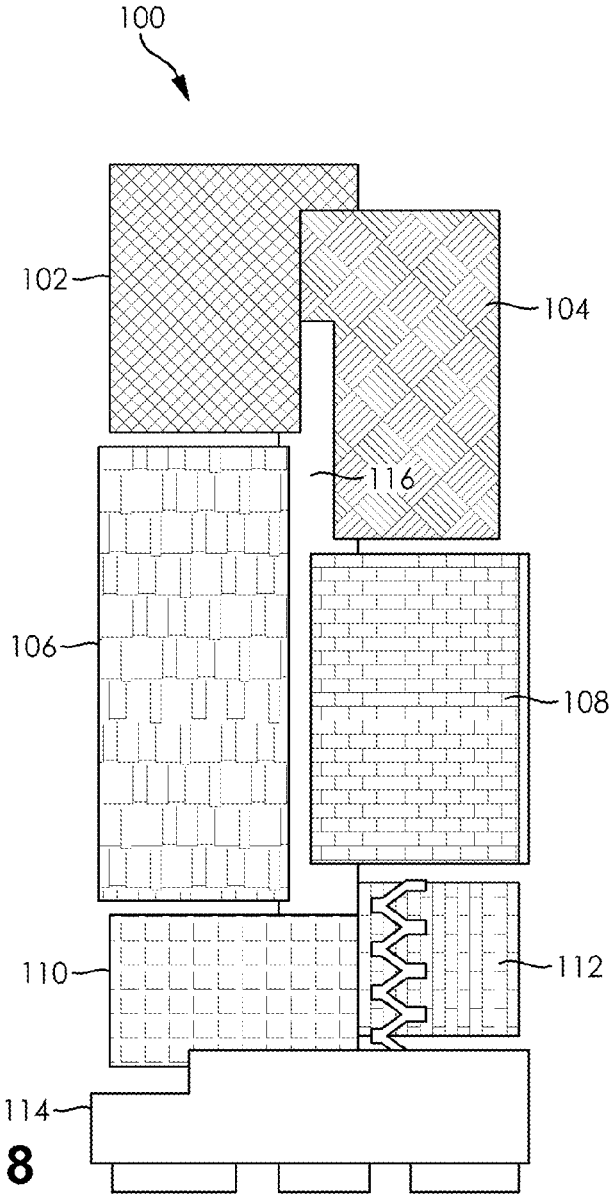
FIG. 8 is a left view of a multi-floor building construction, in accordance with an embodiment of the present invention.

Turning now to FIG. 4, an exemplary embodiment of a multi-floor building construction in accordance with an embodiment of the present invention. In a preferred embodiment, the multi-floor building 100 is comprised of multiple building segments (102, 104, 106, 108, 110, and 112) that each have different façades and offsets from adjacent building segments. In a preferred embodiment, each of the multiple building segments are connected to a core structure (not shown) and the podium 114 acts as the visual transition between the ground floor and the tower.

Turning now to FIGS. 5-8, an exemplary embodiment of a multi-floor building construction in accordance with an embodiment of the present invention. In a preferred embodiment, the multi-floor building construction is comprised of multiple building segments (102, 104, 106, 108, 110, and 112) that are arranged around and connected to a core structure 116. This arrangement of building segments, allows for the multi-floor building construction to have open-air areas between each of the building segments. In a preferred embodiment, each of the multiple building segments that are connected to the core structure 116 and suspended over a podium 114 to which the core structure 116 is connected.

Figure 9:
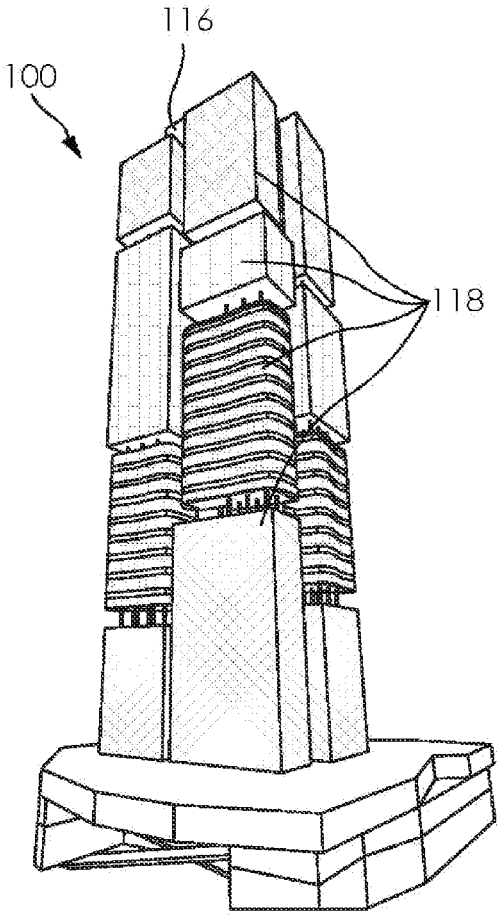
FIG. 9 is a perspective view of a multi-floor building construction, in accordance with an embodiment of the present invention.
Figure 10:
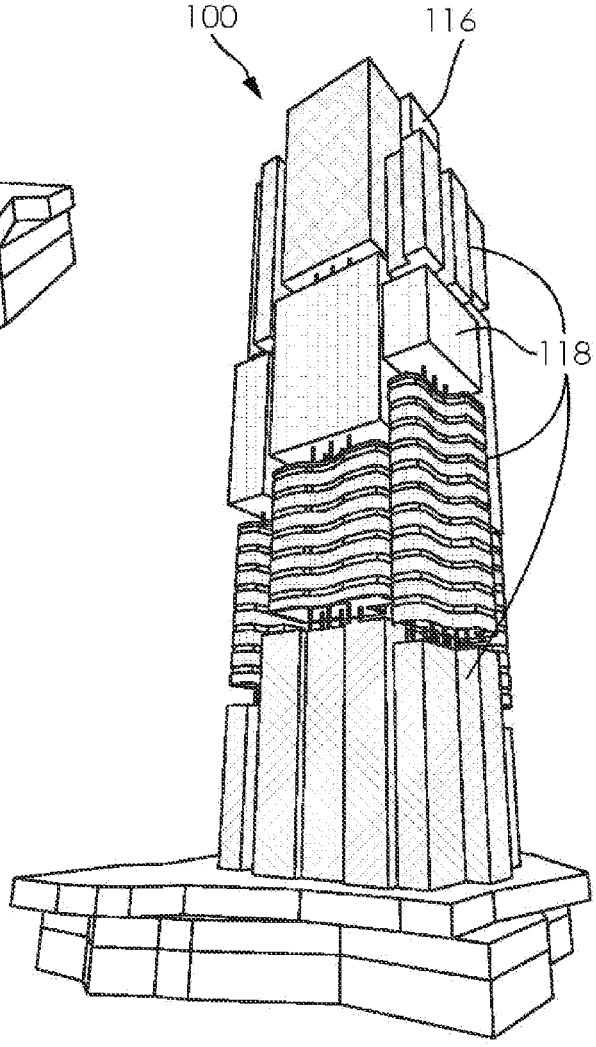
FIG. 10 is an alternate perspective view of a multi-floor building construction, in accordance with an embodiment of the present invention.

Turning now to FIGS. 9 and 10, an exemplary embodiment of a multi-floor building construction in accordance with an embodiment of the present invention. In this exemplary embodiment, the multi-floor building construction 100 is comprised of a core structure 116 that connects multiple building segments 118, each of which has a different façade. In the preferred embodiment, each segment of the building may also be offset compared to adjacent portions of the building. This combination of different façades and the varying offset of the building segments help to create the illusion that each building segment is a separate building. In the preferred embodiment, the core structure 116 of the multi-floor building construction 100 allows for the use and varying offsets of the multiple building segments 118.

Figure 11:
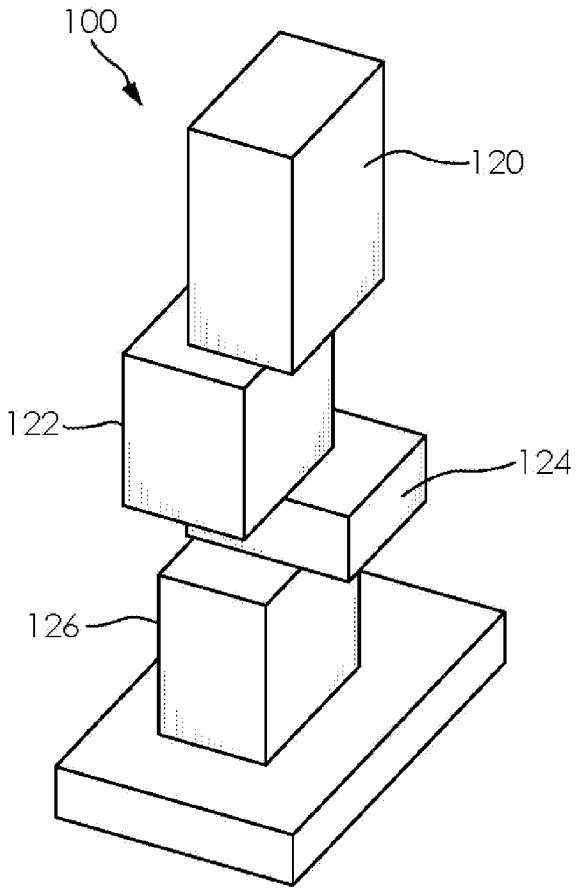
FIG. 11 is a block model illustration of the offset of the various building portions of a multi-floor building construction, in accordance with an embodiment of the present invention.

Turning now to FIG. 11, is block model of an exemplary embodiment of a multi-floor building construction in accordance with an embodiment of the present invention. In a preferred embodiment, the multi-floor building construction may be comprised of multiple building segments (120, 122, 124, 126). Each of these building segments may be offset from each other so as to offer changing sight lines along the axes of the building. Furthermore, offsetting the various building segments of the building may give the illusion that each segment is actually a separate building.

Figure 12:
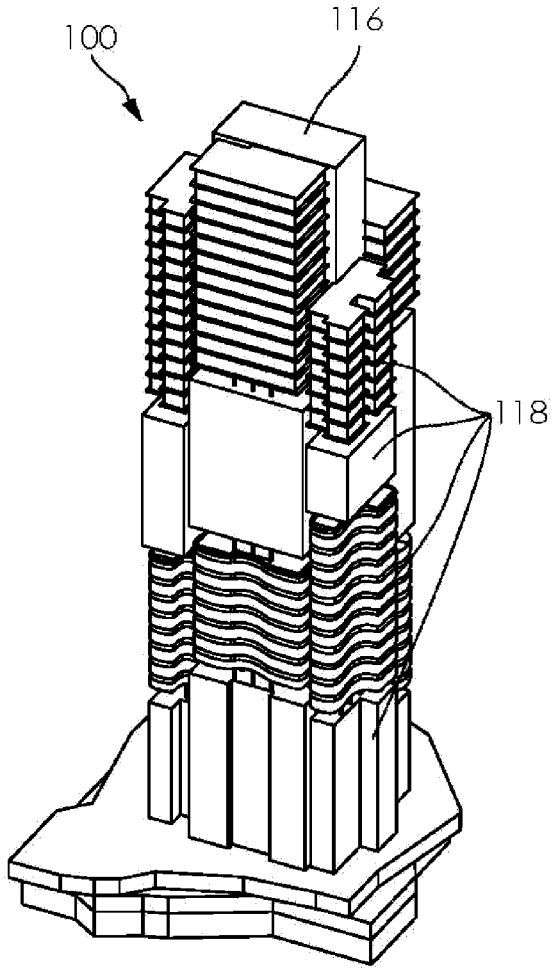
FIG. 12 is a perspective of a multi-floor building construction, in accordance with an embodiment of the present invention.
Figure 13:
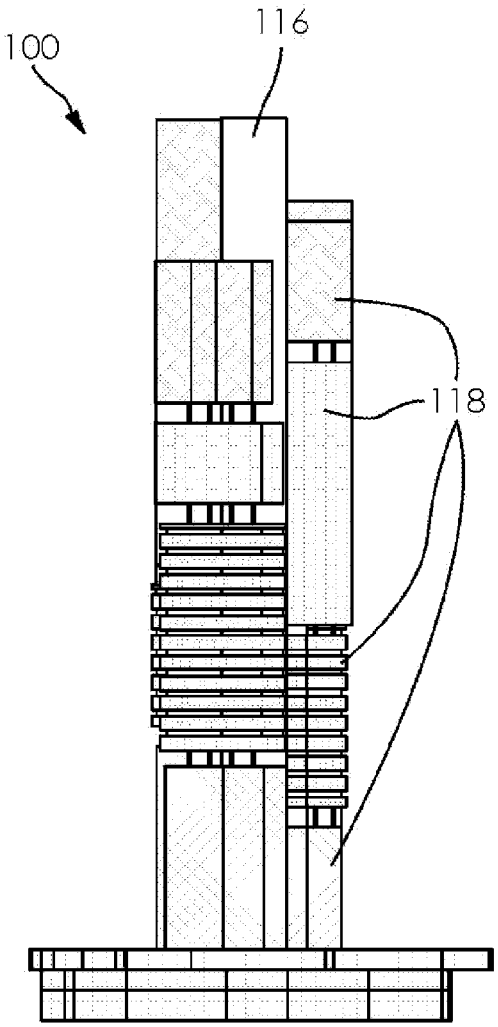
FIG. 13 is a front view of a multi-floor building construction, in accordance with an embodiment of the present invention.
Figure 14:
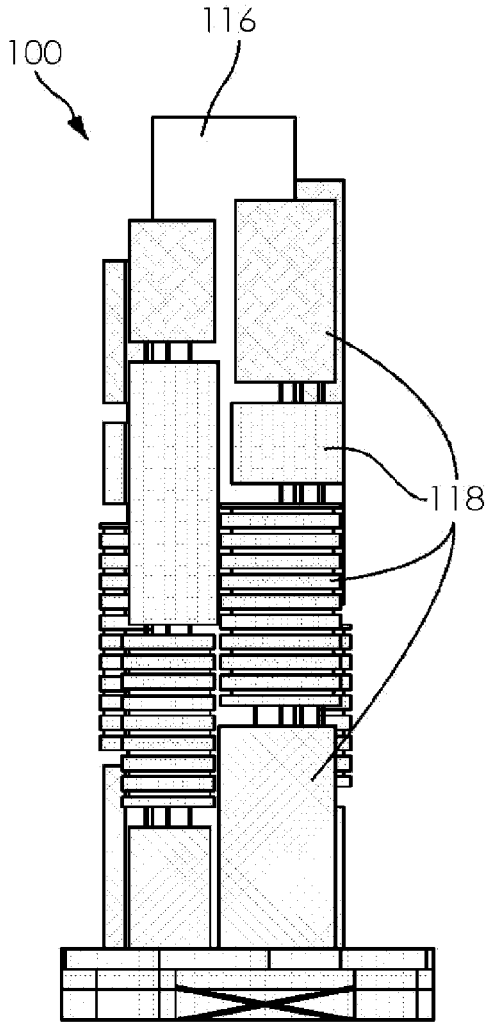
FIG. 14 is a right view of a multi-floor building construction, in accordance with an embodiment of the present invention.
Figure 15:
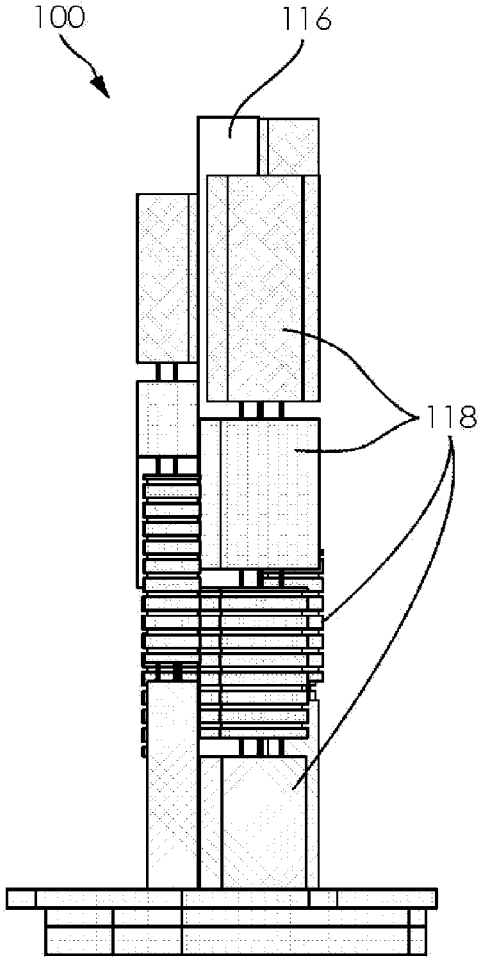
FIG. 15 is a rear view of a multi-floor building construction, in accordance with an embodiment of the present invention.
Figure 16:
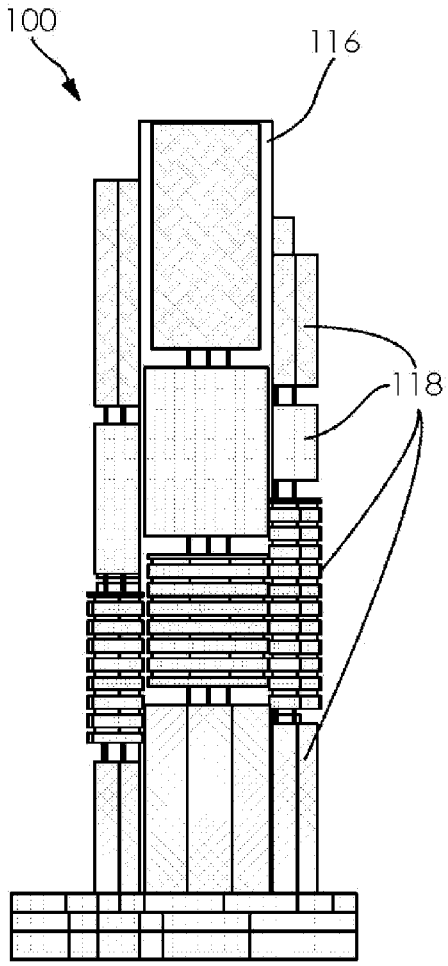
FIG. 16 is a left view of a multi-floor building construction, in accordance with an embodiment of the present invention.

Turning now to FIG. 12, an exemplary embodiment of a multi-floor building construction in accordance with an embodiment of the present invention. In a preferred embodiment, the multi-floor building 100 is comprised of a core structure 116 that connects multiple building segments 118 that each have different façades and offsets from adjacent building segments.

Turning now to FIGS. 13-16, an exemplary embodiment of a multi-floor building construction in accordance with an embodiment of the present invention. In a preferred embodiment, the multi-floor building construction is comprised of multiple building segments 118 that are arranged around and connected by a core structure 116. This arrangement of building segments, allows for the multi-floor building construction to have open-air areas between each of the building segments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A multi-floor building construction, comprising:

a single, cohesive building having a plurality of three or more building portions, wherein at least three of said building portions have a different and distinguishable external facade, whereby said single cohesive building has the appearance of a multi-segmented building; and a core structure from which each building portion extends from, said core structure connecting said three or more building portions and allowing each building portion to be a separate unit that is physically distinct from an adjacent building portion; said core structure extending vertically through the central axis of the multi-floor construction;

wherein each building portion comprises an open-air area separating a single building portion from adjacent building portions, each building portions' open-air area is vertically offset from an adjacent building portions' open-air area;

wherein each open-air portion extends from the core structure and marks the boundary between adjacent building portions; and wherein at least three of said building portions comprise a differing and distinguishable floor plan.

2. The multi-floor building construction of claim 1, wherein said open-air space is at least partly enclosed by a material that gives such enclosed space the appearance of being open.

3. The multi-floor building construction of claim 1, wherein said open-air space is at least partly enclosed, but providing the appearance of being open by using protection features for ventilation and air circulation.

4. The multi-floor building construction of claim 1, wherein at least one of said building portions has a non-rectangular shape.

5. The multi-floor building construction of claim 1, wherein each of said building portions has different physical properties selected from the group consisting of: external shape, external size, internal layout, and external façade.

6. The multi-floor budding construction of claim 1, wherein at least one of said building portions is offset relative to at least one other of said building portions.

7. The multi-floor building construction of claim 1, wherein a segment of said core structure is exposed to the outside.

8. The multi-floor building construction of claim 1, wherein said multi-floor building construction has two or more core structures connecting said three or more building portions.

9. The multi floor building construction of claim 1, wherein the surfaces of the building portions that comprises said open-air areas are parallel to each other.

10. The multi floor building construction of claim 1, wherein the surfaces of the building portions that comprises said open-air areas are not parallel to each other.

11. The multi floor building construction of claim 1, wherein at least one of the surfaces of the building portions that comprises said open-air areas is not coplanar.

12. The multi floor building construction of claim 1, wherein one or more building portions are separate horizontally from the adjacent building portions.

13. The multi floor building construction of claim 1, wherein such multi-floor building construction includes a podium.

14. The multi floor building construction of claim 1, wherein such multi-floor building construction includes a ground floor plaza.

15. The multi floor building construction of claim 1, wherein one or more of the building portions feature a duplex layout.

16. The multi floor building construction of claim 1, wherein one or more of the building portions feature a loft layout.

* * * * *